US010980691B1

(12) United States Patent
Sverdlik et al.

(10) Patent No.: US 10,980,691 B1
(45) Date of Patent: Apr. 20, 2021

(54) MOBILE SEAT SUPPORTING TRANSFER APPARATUS

(71) Applicants: David Sverdlik, Buffalo Grove, IL (US); Alla Sverdlik, La Jolla, CA (US); Bella Dishell, Los Angeles, CA (US)

(72) Inventors: David Sverdlik, Buffalo Grove, IL (US); Alla Sverdlik, La Jolla, CA (US); Bella Dishell, Los Angeles, CA (US)

( * ) Notice: Subject to any disclaimer, the term of this patent is extended or adjusted under 35 U.S.C. 154(b) by 0 days.

(21) Appl. No.: 16/828,705

(22) Filed: Mar. 24, 2020

Related U.S. Application Data

(60) Provisional application No. 62/866,769, filed on Jun. 26, 2019.

(51) Int. Cl.
*A61G 7/10* (2006.01)
*A61G 9/00* (2006.01)

(52) U.S. Cl.
CPC ..... *A61G 7/1007* (2013.01); *A61G 7/1046* (2013.01); *A61G 7/1051* (2013.01); *A61G 7/1059* (2013.01); *A61G 7/1073* (2013.01); *A61G 9/003* (2013.01)

(58) Field of Classification Search
CPC .. A61G 7/1007; A61G 7/1051; A61G 7/1059; A61G 7/1073; A61G 7/1049; A61G 7/02; A61G 7/1009; A61G 9/003; A61G 5/10; A61G 5/1002; A61G 7/10; A61G 7/1096; A61G 13/1245; A61G 13/123
See application file for complete search history.

(56) References Cited

U.S. PATENT DOCUMENTS 2,710,975 A * 6/1955 Stoen ..... A61G 7/1015 5/84.1
3,272,453 A * 9/1966 Hallock ..... B65H 57/20 242/386
3,373,453 A * 3/1968 Goodman ..... A61G 7/012 5/611
5,255,934 A * 10/1993 Wilson ..... A61G 5/045 180/907
5,526,537 A 6/1996 Conrad
5,704,439 A * 1/1998 Kitahama ..... A61G 7/1046 180/65.1
5,725,275 A 3/1998 Wigfall
6,154,899 A 12/2000 Brooke et al.
(Continued)

*Primary Examiner* — Robert G Santos
*Assistant Examiner* — Alison N Labarge
(74) *Attorney, Agent, or Firm* — Brian Roffe

(57) ABSTRACT

Transfer apparatus designed as a mobile, generally C-shaped frame assembly including top and bottom portions removably connected by at least one spacer and a seat adapted to support a patient in a sitting or suspended sitting position at multiple levels. A horizontal part of the top portion is a seat support, the bottom portion is a wheeled base, and spacers fix a selected height of the seat support. The apparatus operates on patient support surfaces with and without vertical movement capability, enables use of a commode over and away from the bed by the patient in a seating position, and enables changing of a seat under the sitting patient. The transfer apparatus provides a cost effective, lightweight, rigid, without moving parts mobile seat support assembly as a commode/wheelchair (C/W) capable of performing multifunctional safe patient transfer to and from patient support surfaces with and without vertical movement.

17 Claims, 4 Drawing Sheets

(56) References Cited

U.S. PATENT DOCUMENTS

| | | | | |
|---|---|---|---|---|
| 6,176,508 | B1 | 1/2001 | Malassigne et al. | |
| 6,185,769 | B1 | 2/2001 | Larisey, Jr. et al. | |
| 6,418,571 | B1 | 7/2002 | Cheng | |
| 6,547,265 | B1 * | 4/2003 | Enge | A61G 5/1002 135/66 |
| 7,520,518 | B2 * | 4/2009 | Peterson | A61G 5/00 280/250.1 |
| 9,393,167 | B2 | 7/2016 | Ganel | |
| 9,820,901 | B2 * | 11/2017 | Brown | A61G 5/14 |
| 10,292,880 | B2 * | 5/2019 | Chang | A61G 5/128 |
| 2004/0093673 | A1 * | 5/2004 | Marshall | A61G 13/12 5/650 |
| 2005/0104319 | A1 | 5/2005 | Wing | |
| 2006/0048296 | A1 * | 3/2006 | Sutou | A61G 7/1094 4/667 |
| 2007/0124859 | A1 | 6/2007 | Stryker et al. | |
| 2010/0154115 | A1 * | 6/2010 | Wernqvist | A61G 7/1096 5/86.1 |
| 2014/0208493 | A1 * | 7/2014 | Ahmed | A61G 7/053 4/237 |
| 2015/0272797 | A1 | 10/2015 | Hines | |
| 2017/0056267 | A1 | 3/2017 | Stryker et al. | |
| 2017/0252259 | A1 * | 9/2017 | Evans | A47C 27/00 |
| 2019/0350411 | A1 | 11/2019 | Hart et al. | |

* cited by examiner

MOBILE SEAT SUPPORTING TRANSFER APPARATUS

FIELD OF THE INVENTION

The present invention relates generally to a mobile seat supporting transfer apparatus to be used as a commode/wheelchair adapted for direct transfer patient from a patient support surface at multiple levels to a seat, and for moving the patient in a sitting or a suspended sitting position.

BACKGROUND OF THE INVENTION

In the prior art, there are transfer apparatus for people that are used to transfer a disabled person to or from a wheelchair.

U.S. Pat. No. 6,547,265 describes a transfer wheelchair including a base frame with integral toileting platform, a seating platform for receiving a human user thereon, and removably attachable structure for supporting a user's torso and arms. The frame has two C-shaped legs, wheels that allow frame to roll along the ground, and supports a toileting platform. The wheelchair apparatus has a seating platform for removably receiving a user on top of the toileting platform.

The invention described in U.S. Pat. No. 6,547,265 is an important development in transferring bedridden patients to the commode-wheelchair that does not require a caregiver to lift the user's entire body during transfer on to or off the chair. At the same time, the patented design of the chair apparatus limits its operational capacity and can be used only on beds with vertical movements at specified mattress height for transfer. Changing seats requires lifting the patient about the existing seat, and the storage and packaging of the chair apparatus are limited by the size of the assembly.

U.S. Pat. Appln. Publ. No. US20170056267A1 describes a transport apparatus for moving a person from one location to another location or transporting a person from one support to another support. The transport apparatus includes a base, a sling, and a support frame mounted to the base and movable between different positions relative to the base.

This apparatus is similar to many existing devices and has common operational procedures: the sling is the seat supporting patient in a suspended sitting position, changing the sling can be done only by removing a first sling and repeating the operation of placing the first seat. The apparatus requires a powered drive, and is expensive with limited operational capacity.

These prior art transfer apparatuses design for limited selective transfer operations, are bulky, do not provide simple transfer patient, seat replacement and also do not enable patient transfer for both support surfaces that are vertically movable as well as support surfaces that are not vertically movable.

OBJECTS AND SUMMARY OF THE INVENTION

1. Develop a cost-effective, multifunctional, mobile seat supporting transfer apparatus to be used as a commode/wheelchair adapted for direct transfer patient from a multi-level patient support surface to the seat, and for moving the patient in a sitting or a suspended sitting position.
2. Use the toilet or bedpan above or away from the bed.
3. Change the seat under the patient in a sitting or a suspended sitting position.

4. Place a garment on the patient while in a suspended sitting position.
5. Use a transfer apparatus to transfer a patient on the surface with and without vertical movements.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
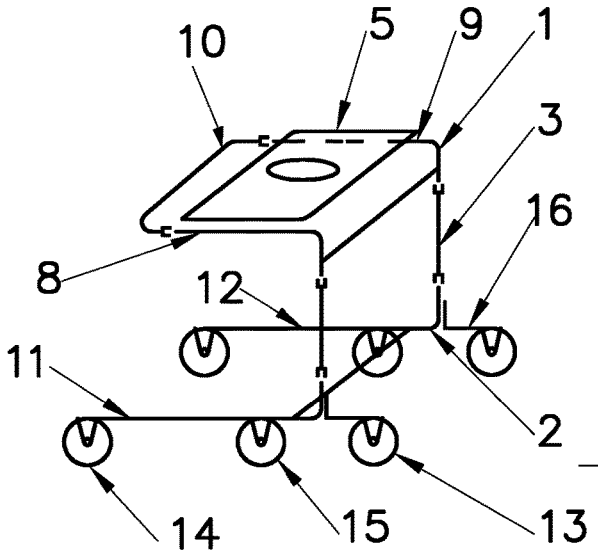
FIG. 1 is a front perspective view of a transfer apparatus in accordance with the invention.

Referring to the accompanying drawings wherein like reference numbers refer to the same or similar elements, FIG. 1 is a perspective view of a transfer apparatus in accordance with the invention in one of a plurality of different configurations. The transfer apparatus has several different configurations and different removable attachments, for example, seats and spacers, that may be used alternatively or in various combinations. Some of these variations are described, but it will be understood by those skilled in the art to which this invention pertains in view of the disclosure herein that other variations of the transfer apparatus are possible, and all such variations are considered to be within the scope and spirit of the invention, and claims.

FIG. 1, the commode/wheelchair (C/W) transfer apparatus is designed as a rigid mobile "C" shape frame assembly to support and move a seat 5 with a sitting patient 6 at one of many selectable heights. The "C" shape frame assembly is built as an assembly of two C-shaped side frames and includes a top portion 1 and a bottom portion 2, connected via removable spacers 3.

Each of the top portion 1 and bottom portion 2 has a design of two 90-degree positioning bars, as an elongate bar 8, 9, 11, 12 and the short bars. The elongate bars 8, 9, 11, 12 are preferably built as 90 degree bent tubes and are connected with a cross bar.

The cross bar can be length adjustable and have different configurations. Elongate bars 8 and 9 and 11 and 12 form a horizontal part of the top portion 1 and bottom portion 2, respectively. The vertical parts of the 90 degrees bended tubing of the top and bottom portions 1, 2 are adapted for secure connection with the removable spacers 3. The elongate bars 8 and 9 form a seat support 4 for the seat 5. The bottom portion 2 is a wheeled base, adapted for removable attachment of pairs of wheels 13, 14, and 15, wherein the wheels 13 are front, wheels 14 are back or rear, and wheels 15 are positioned between wheels 13 and 14, intermediate wheels.

The spacers 3 design to connect the top portion 1 and bottom portion 2 of the "C" frame assembly and position the seat support 4 to support and move seat 5 with a sitting patient 6 at one of many selectable heights. The spacers 3 can be length-adjustable or have a selected length.

The cross bar can be removably connected to the bended tubing and be length adjustable. The elongate bars 8, 9, 11, 12 can have removable adjustable extensions attached to the ends of the elongate bars 8, 9, 11, 12 to accommodate different size patient.

The removable bar 10 may be attached to the elongate bars 8 and 9 for seat support 4 reinforcement. The removable bar 10 may be attached to the elongate bars 8 and 9 after the patient 6 is in a sitting position on the seat 5 supported by a mattress 7 which is an example of a patient support surface (see FIG. 2). The removable bar 10, can be part of the removable back support for the sitting patient 6. Without removable bar 10, the elongate bars 8 and 9 can egress and ingress over the support surface 7 to connect and move the seat 5 with the patient 6.

As was described above, the C/W assembly as a seat transfer apparatus can be used as a commode or as a wheelchair. The difference between commode and wheelchair is a seat 5, where the seat for the commode is provided with an opening to use the toilet or the bedpan.

Figure 2:
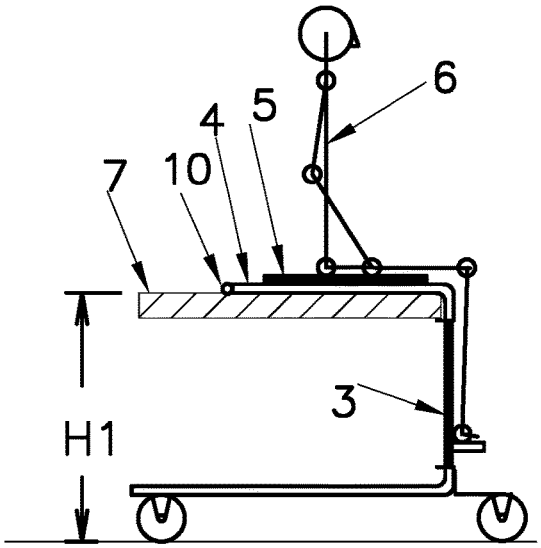
FIG. 2 is a side view of the transfer apparatus with a patient in a sitting position on a seat releasably attached to a seat support.

In FIGS. 1 and 2, the first C/W model uses the seat 5 releasably connected directly to the height-adjustable seat support 4.

Figure 3:
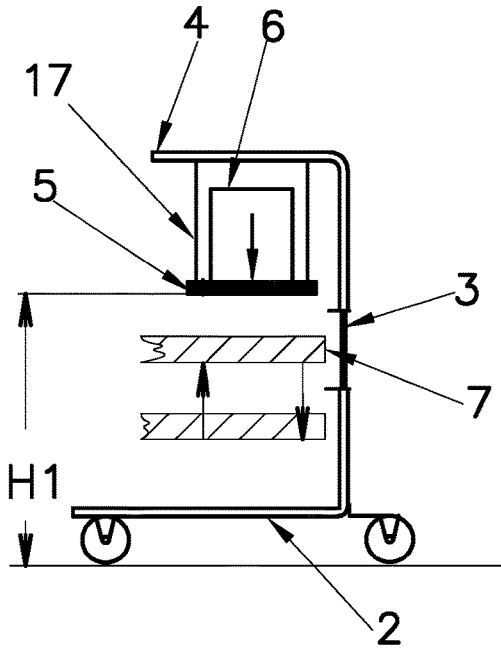
FIG. 3 is a side view of the transfer apparatus with a seat removably attached to a seat support.

In FIG. 3, a second C/W model has a seat 5 removably attached to the seat support 4 via links 17. The vertical position of the seat 5 is adjustable by varying the length of the links 17.

The "C" shaped frame assembly of the second C/W model can be designed as the first C/W model, shown in FIGS. 1, 2 and 3, wherein the top and bottom horizontal portions are connected by spacers 3, and the height of the seat 5 can be adjusted by positioning the seat support 4 or links 17.

With the ability to adjust the height of the seat 5 and thus the seat position by adjusting the length of the links 17, the design of the "C" shaped frame assembly can be simplified by build it as two "C" shape side frames connected with one or more fixed or length adjustable cross bars. For packaging and storage vertical bars can be cut and connected by a spacer 3, FIG. 3.

The top horizontal bars form the seat support 4 and are adapted for removable connection to links 17, supporting seat 5 and removable bar 10, where the bottom horizontal bars are part of the wheeled base.

It will be understood by those skilled in the art how to design the solid vertical "C" shaped sides frame, with a modification of the connection by a spacer.

FIGS. 1-4 depict the seat 5 as a single layer seat.

Figure 8:
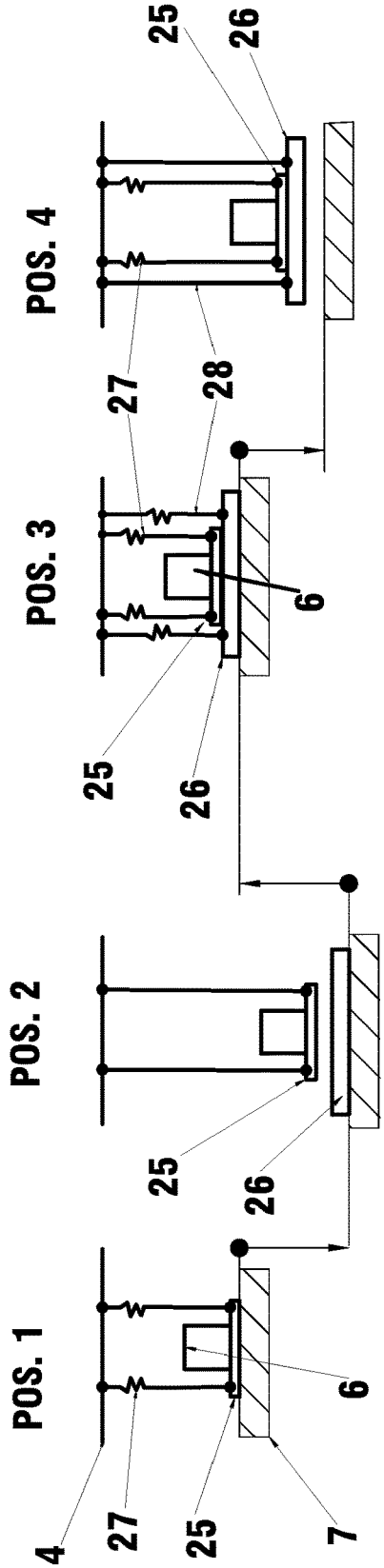
FIG. 8 is a series of depictions showing stages of seat replacement under the patient in a suspended sitting position on the support surface with vertical movement.
Figure 9:
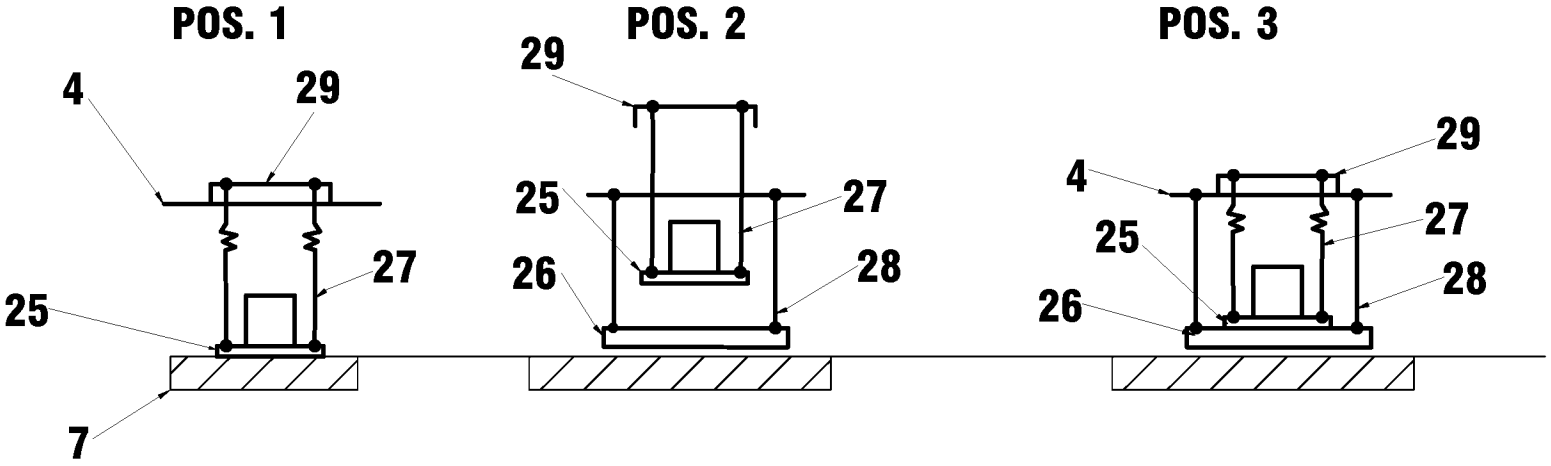
FIG. 9 is a series of depictions showing stages of seat replacement, wherein seat with a sitting patient is adapted for applying vertical movements.
Figure 10:
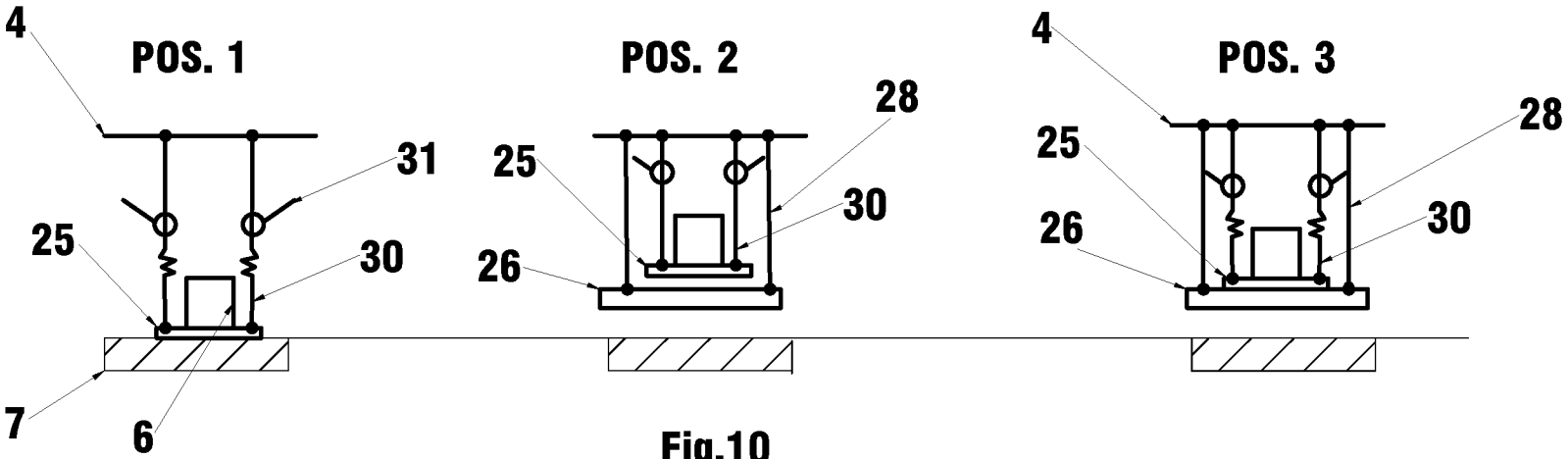
FIG. 10 is a series of depictions showing stages of seat replacement under the patient in a suspended sitting position by using a powered length adjustable links.

FIGS. 8-10 depict the seat 5 as a set of two seats (a multi-element seat): a first seat 25 and a second seat 26 connected to the seat support 4 with connecting elements, which can be flexible links.

FIGS. 2-11 describe multifunctional operational capacity of the transfer apparatus.

Operations of Patient Transfer.

1. Transfer a Patient on a Bed with Vertical Movement.

The operation includes transferring a patient from a supine position directly to a sitting position on the seat 5 and moving the patient in a suspended sitting position above or away from the bed.

FIG. 2, describing use of the first C/W model, wherein the spacers 3 set the seat support 4 to transfer the patient on the mattress 7 of a bed at a height H1.

The C/W moves over the mattress 7 at the potential patient sitting position, where the potential sitting position is the patient's position on the mattress 7 after he rolled from a lying to a sitting position on the mattress 7. The mattress 7 moves up to transfer the patient onto the seat 5. After the patient transfer, the bed is moved down, and the C/W moves away from the bed.

FIG. 3, describing use of the second C/W model, wherein the seat 5 is removably attached to the seat support 4 via links 17. The seat support 4 is set to move the patient at the mattress height H1. The seat 5 is placed on the mattress 7 separately from the second C/W model at any mattress height that is comfortable for the caregiver, to transfer the patient onto the seat 5. After the patient is transferred, the bed with the mattress 7 moves to a height to enable connection of the seat 5 with the seat support 4. By moving the mattress 7 down, the links 17 support the seat 5 with the patient in a suspended sitting position and enable the patient to be moved away from the mattress 7.

2. Operation of Using the Bedpan Over the Bed in a Sitting Position.

Figure 4:
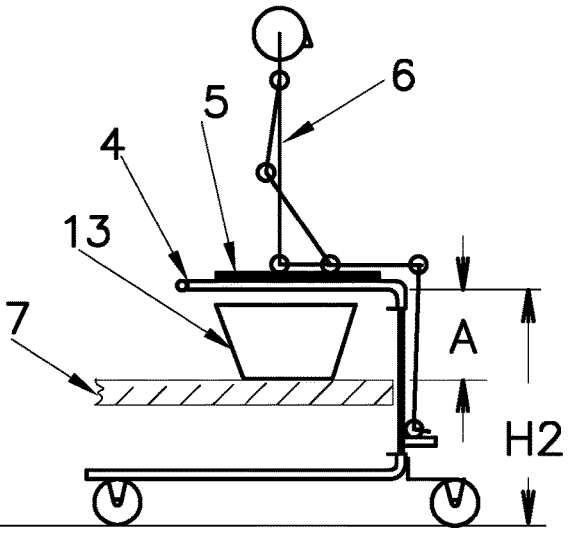
FIG. 4 is a side view of the transfer apparatus and mattress position to enable use of a bedpan above the mattress by a patient in a suspended sitting position.

Referring to FIG. 4, using either the first or second C/W models, the seat support 4 is set for transfer the patient 6 at the mattress height H2, where lowering the mattress 7 provides a space "A" for positioning a bedpan or toilet 18 on the mattress 7 of the bed under the seat 5 with the patient 6 in a sitting position. The operation is identical for both models.

For patient repositioning on the support surface 7 with vertical movements, the wheeled base comprises only front 13 and rear 14 pairs of wheels, FIGS. 2-4, and allows for movement of the "C" shaped frame assembly while set in a vertical position.

3. Operation of Transferring a Patient Over on a Bed without Vertical Movement

Figure 5:
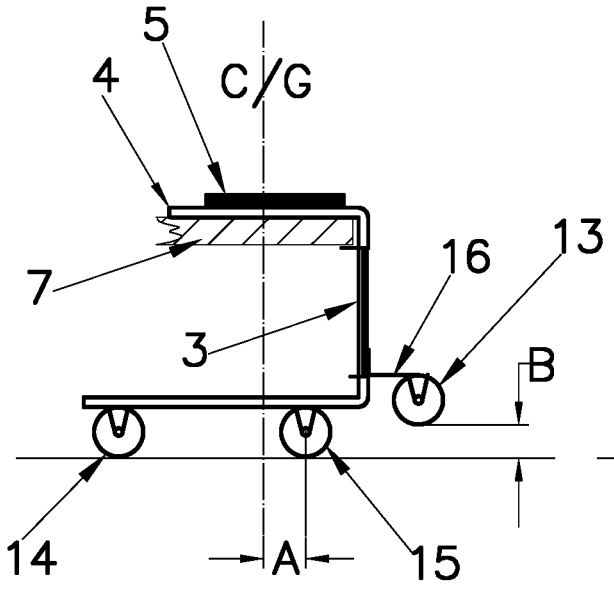
FIG. 5 is a side view of the transfer apparatus showing setup of wheels to tilt the C shaped frame on the specified angle over the mattress and the seat support position on the mattress when transferring a patient to and from the seat.
Figure 6:
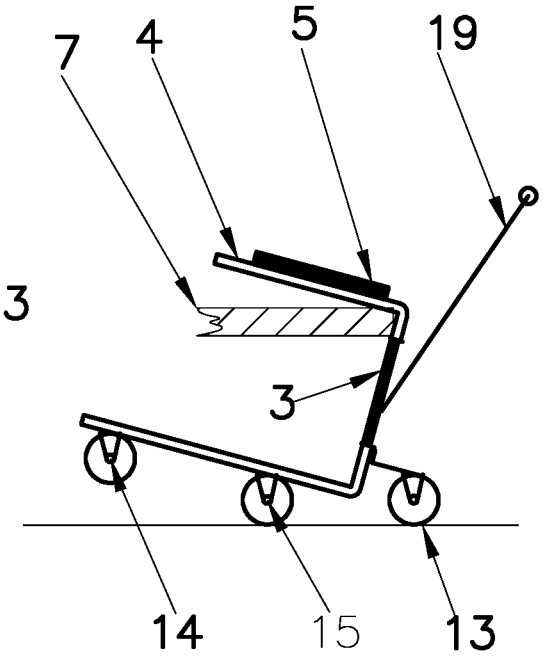
FIG. 6 is a side view of the transfer apparatus shown in a configuration for transferring a patient in or out of the support surface.

FIGS. 5 and 6 describe patient transfer operation by using the C/W first model, where the seat 5 releasable attached to the seat support 4. To prevent interference of the seat support 4 with the support surface 7 in moving over the surface 7, the "C" shaped frame assembly is tilted on the angle to move over the support surface 7. Tilting the "C" shaped frame assembly on five or even less degrees creates sufficient clearance to go over the mattress 7. The spacers 3 set the height of the seat support 4, to be compressed to the mattress 7 in a horizontal over the mattress position.

To move seat support 4 over the mattress, the wheeled base comprising all three pairs of wheels 13, 14, and 15.

FIG. 5 demonstrates the set-up wheels on the wheeled base, where the front wheels 13, supported by a bracket 16 are heights adjustable, the pair of wheels 15 are positioned on the elongate bars 11 and 12 are off the "C" shaped frame assembly's center of gravity (C/G) with the sitting patient toward the front wheels 13.

The pre-set front wheels 13 are positioned at height "B" above the floor, the intermediate wheels 15 are positioned on the distance "A" off the center of gravity C/G, and the rear wheels 14 are attached to the ends of the elongate bars 11 and 12.

The set-up of wheels 13 and 15 defines the angle and force to move the "C" shaped frame assembly with sitting patient.

The "C" shaped frame assembly, with or without a patient, can be moved over the mattress 7 and turned to the horizontal position shown in FIG. 5. After the patient is transferred onto the seat, the removable, support bracket 19 attached to the frame for patient security and the "C" shaped frame assembly with the sitting patient can be removed from the bed. Support bracket 19 is also considered a removable attachment front patient support as the patient can support themselves on it as shown in FIG. 7

For a short travel distance, the "C" shaped frame assembly with patient can be moved in vertical position on the sets of wheels 14 and 15. For a long travel distance, it is preferable to lower the front wheels 13 to the floor or ground.

The pair of front wheels 13 is designed for fast and simple move on or above the floor. 4. Seat Replacement Under the Patient in a Seating Position on the First C/W Model.

Figure 7:
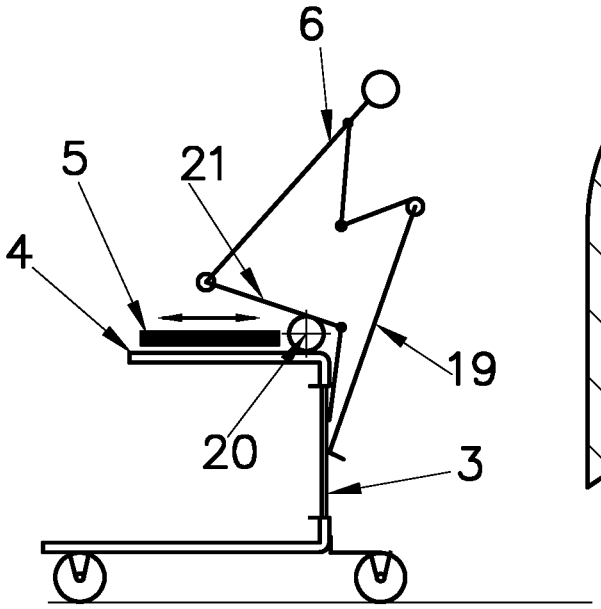
FIG. 7 is a side view of the transfer apparatus showing use of an additional support to facilitate seat replacement under the sitting patient.

Referring to FIG. 7, the first C/W model, a removable elevation 20 is positioned on the seat support 4 under the patient's legs 21. Holding the support 19, the patient is able to pull himself over the attached elevation 20, creating space for changing seat 5 he was previously sitting on. A rotation over elevation 20 is much easier for the patient (who is able to do so) than lifting the body, and the patient can do it by himself or with caregiver assistance.

5. Seat Replacement Under the Patient in a Suspended Sitting Position.

The presented descriptions below are only demonstrations of the concept and some practical applications, and do not limited the invention or the scope of the claims.

FIGS. 8-10 describe operations of seat replacement under the patient in a suspended sitting position.

The seat 5 is configured as a set of a first seat 25 and a second seat 26, removably connected to the seat support 4 with removable attached links 27 and 28, respectively.

The first seat 25 is used like a regular single-layer seat 5 described in FIGS. 1-7 for patient transfer and support, preferably in a suspended sitting position and including an opening to use as a toilet or bedpan.

The first seat 25 is preferably fabricated from a strong, soft and thin material, and as an example, it can be material suitable for fabricating a sling to support and transfer a patient in a suspended position, for example, plastic or other similar material.

The second, underlying replaceable seat 26 is removably attached to the seat support 4 by links 28 which are shorter than links 27 connecting the first seat 25 to the seat support 4. Connecting the second seat 26 to the seat support 4 enables release of tension on the first seat 25.

The second seat 26 can have different shapes, thickness, and design for patient comfort. The second seat 26 utilizes different requirements to be used as a seat for a commode or wheelchair with varying levels of patient comfort, or medical procedures or requirements.

The manner in which the first seat 25 and the second seat 26 are attached to the "C" shaped frame assembly is designed depends on the source of vertical power and presented in diagrams in FIGS. 8-10.

For better demonstration, the presentations are made using the second model of the C/W, wherein the first and second seats 25 and 26 are attached to the seat support 4 via flexible links.

Second Seat Replacement Under the Patient in a Sitting Position on Beds with Vertical Movements FIG. 8 demonstrates replacement of the second seat 26, with several steps of seat replacement on beds capable of vertical movements as follows:

Position 1 (POS 1)—the first seat 25 with a sitting patient 6 are connected by links 27, in a tension-free state, to the seat support 4, positioned over the bed.

Position 2 (POS 2)—the mattress 7 is moved down so that the links 27 support the first seat 25 in a tensioned state, and space for the second seat 26 is created. The second seat 26 is placed on the mattress 7.

Position 3 (POS 3)—the mattress 7 is moved up, the first seat 25 is resting on the second seat 26, and links 28 are connected to the seat support 4. The links 27 and 28 are in a tension-free state, i.e., tension has been released.

Position 4 (POS 4)—by moving the mattress 7 down, the second seat 26 connected to the seat support 4 with links 28 takes over support of the patient, and releases tension on the first seat 25 via the links 27.

To replace the second seat 26, mattress 7 is moved up. Links 27 are connected to the seat support 4, and the second seat 26 is disconnected from the links 28. By moving the mattress 7 down, the second seat 26 can be replaced.

Second Seat Replacement Under the Patient Supported by a Patient Support Surface without Vertical Movement or in a Suspended Sitting Position.

FIG. 9 is a series of depictions showing stages of seat replacement under the patient in a suspended sitting position by applying lift (vertical movement) to the seat.

Removable attachment support 29 is positioned on the seat support 4. Links 27 removably connect the first seat 25 to the support 29. The links 28 removably connect the second seat 26 to the seat support 4.

The stages of the seat replacement are as follows:

Position 1 (POS 1)—the first seat 25 with sitting patient 6 on the mattress 7, the support 29 rests on the top of the seat support 4 and the links 27 connect the first seat 25 to the support 29.

Position 2 (POS 2)—vertical force is applied to the support 29 to lift the support 29 with attached first seat 25, creating space for positioning and connecting the second seat 26 to the seat support 4 via links 28.

Position 3 (POS 3)—the support 29 moves down, the first seat 25 rests on the second seat 26, and the support 29 seats on the seat support 4.

The source of the vertical movement of the support 29 can be any powered or manual lifting mechanisms or systems.

Seat Replacement Under the Patient by Using Length Adjustable Connecting Links.

FIG. 10 demonstrates the use of the mechanically length adjustable connecting links to attach or replace the second seat under the patient in a suspended sitting position.

The mechanically length adjustable connecting links are links 30 incorporating one of many strap Tie-down System 31 or others devices generating power to shortening or extend length of the connection.

The stages of the seat replacement are as follows:

Position 1 (POS 1)—the first seat 25 with the sitting patient is connected to the seat support 4 via removable length adjustable links (referred to as adjustable connection means) 30.

Position 2 (POS 2)—by using length adjustable devices 31, the links 30 lift the first seat 25 allowing connection the second seat 26 via links 28 to the seat support 4.

Position 3 (POS 3)—by loosening belts 30 by device 31, the second seat 26 takes over support of the patient and the first seat 25. The first seat 25, relieved from a tensioned state, will stay under the patient and the second seat 26.

The length adjustable links can be used on a single layer seat or a seat assembly which is a set of two seats (as described above) used to transfer a patient between different support surfaces with and without vertical movements.

The foregoing described seat replacements are effortless, safe, simple and can be used in many devices by a single caregiver.

Figure 13:
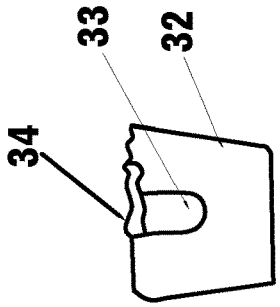
FIGS. 12 and 13 show the garment in accordance with the invention.
Figure 11:
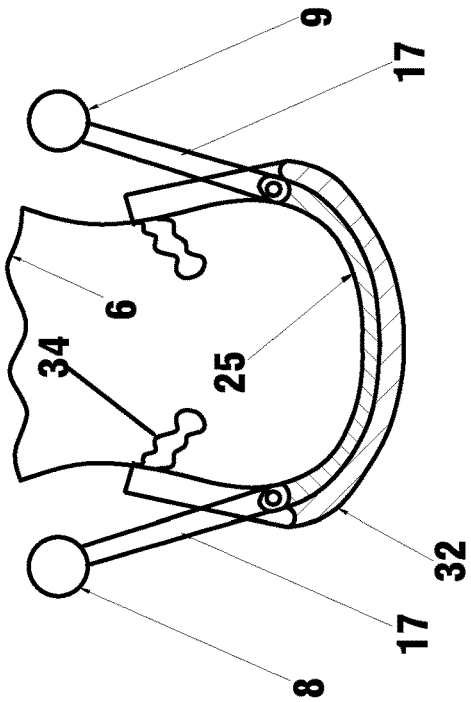
FIG. 11 is a demonstration of placing a garment in accordance with the invention over the patient in a suspended sitting position.
Figure 12:
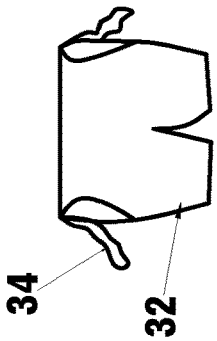

FIGS. 11-13 Describes Garment Placement on the Patient in a Suspended Sitting Position.

The seat support 4 in combination with the first and second seats 25, 26 creates a valuable opportunity for patient comfort to enable a garment to be put on and removed from the patient in a suspended sitting position. The garment (for example, pants, underwear, skirt or the like) is provided with an opening for the links supporting the first seat 25 so that it can be easily be placed or removed over the first seat 25.

FIG. 11 is a cross section demonstrating a garment 32 over the patient 6 sitting in the first seat 25 supported by links 17 attached to the seat support elongate bars 8 and 9. FIGS. 12 and 13 show the extra opening 33 for the links 17, and strips 34 to close the extra opening 33.

Figure 14:
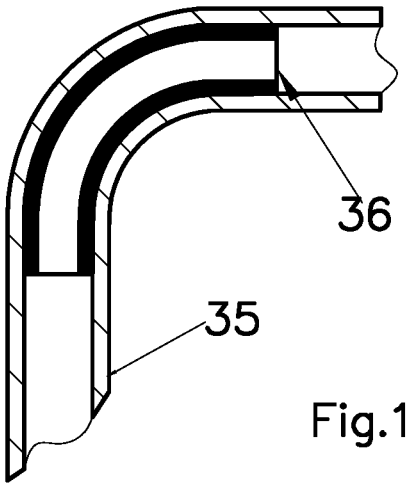
FIG. 14 is a demonstration of the frame constructive elements reinforcement.

FIG. 14 Describes Frame Reinforcement.

Another aspect of the invention relates to the frame reinforcement. Different parts of the "C" shape frame are under different stress loads. For the "C" shaped frame assembly, it is possible to use tubular constructions in order to make the whole structure lightweight, and the portion of the "C" shaped frame assembly's tubes under greater stress may be reinforced by placing inserts 36 inside the tubes 35 and bending them together if needed.

It is obvious, that apparatus adapted to accept varieties of patient supports, existing in industry, providing secure and comfortable patient repositioning.

The "C" shaped frame assembly is a mobile, compact, rigid construction, without moving mechanical part structure, and adapted for simple and quick positioning seat and removable components to perform multi-functional operations providing secure and comfortable for the patients and caregivers.

The "C" shaped frame assembly may be designed as an assembly of components which is compact in service, storage and packaging.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A transfer apparatus, comprising:

a mobile, height-adjustable C-shaped frame assembly;

a plurality of different seats attachable to and removable from said C-shaped frame assembly; and removable connecting elements to connect each of said seats to said C-shaped frame assembly, said removable connecting elements that connect each of said seats to said seat support each comprising manual or mechanical length-adjustable links that enable different lengths between each of said seats and said seat support to be obtained, said C-shaped frame assembly including a top portion, a bottom portion, and at least one spacer that removably connects said top portion and said bottom portion, said bottom portion being a support for removable wheels to enable movement of said C-shaped frame assembly when said removable wheels are supported by said bottom portion, said top and bottom portions of said C-shaped frame assembly being removable, each of said top and bottom portions being designed with two 90 degrees positioning bars, including an elongate portion and a short portion, connected by at least one cross element, said elongate portion of said positioning bars being positioned horizontally, wherein said horizontal elongate portions of said positioning bars of said top portion are a seat support that is adapted for removable attachment to at least one of said seats on the top or under said seat support by said removable connecting elements, wherein each of said seats enables support of a person in a sitting or suspended sitting position, said at least one spacer being straight, length-adjustable or being a selected length bar with an upper end region and a lower end region, wherein said at least one spacer fixes a vertical position of said seat support to support said seat at selected heights of operation, whereby the seat, releasably attached on the top of said seat support, is not obstructed for direct transfer of the person at multiple heights of operation, whereby said C-shaped frame assembly and connection of said seats to said seat support enable applying outside or removable sources of vertical movements to said seats while supporting the person in the suspending sitting position.

2. The apparatus of claim 1, wherein said C-shaped frame assembly comprises two C-shaped sides connected by said at least one cross element which is length-adjustable, and wherein the vertical portion of the C-shaped sides connected by said spacer.

3. The apparatus of claim 1, wherein said seat support, with said seat, attached to the top of said seat support, is configured to tilt over a mattress and positioned at the heights for at least minimum compression to the mattress in a horizontal position, wherein the angle of tilt is preset by position of wheels and height of said seat support set by said at least one spacer.

4. The apparatus of claim 1, further comprising wheels, attached to said bottom portion, and said wheels include front wheels, rear wheels and middle wheels between said front and rear wheels, wherein said front wheels are height adjustable and said middle wheels are positioned off said C-shaped frame assembly's center of gravity with the person sitting toward said front wheels.

5. The apparatus of claim 1, wherein said seat is removably attached to said seat support with mechanical length-adjustable links which constitute said removable connecting elements, wherein said at least one spacer sets said seat support at the heights to position said seat for operation, and wherein said mechanical length-adjustable links adjust clearance to move said seat with a person sitting thereon over a person support surface.

6. The apparatus of claim 1, wherein said C-shaped frame assembly with one of said plurality of seats, attached on the top of said seat support, positioned on a bed at a place for direct transfer of the person from laying to sitting on said one of said plurality of seats, wherein direct transfer set at the height, whereby lowering the bed generates space for positioning a bedpan on a mattress under said one of said plurality of seats, wherein said one of said plurality of seats has an aperture to use the bedpan in a sitting position, and wherein vertical movement of the bed adjusts position of the bed relative to said seat support.

7. The apparatus of claim 1, wherein said removable connecting elements are mechanical length-adjustable links that comprise a mechanism to adjust a length of said mechanical length-adjustable links.

8. The apparatus of claim 7, wherein said mechanism is a removable link or is part of said manually length-adjustable link.

9. The apparatus of claim 1, further comprising at least one of:

a positioning elevation on said seat support; and a front person support removably attachable to said C-shaped frame assembly, whereby said positioning elevation under the person's thighs and said front person support ease lifting and support of the person over or on said seat support.

10. The apparatus of claim 1, wherein one of said plurality of seats comprises a set of a first seat and a second seat configured to be removably connected by respective first and second seat connecting elements to said seat support, fixed at vertical position, said first and second seat connecting elements constituting said removable connecting elements, and wherein said first seat connecting elements are longer than said second seat connecting elements.

11. The apparatus of claim 10, wherein said first seat is configured to be removably coupled to a removable attachment support, movable vertically above said seat support, and said second seat is removably connected to said seat support.

12. The apparatus of claim 10, wherein said first seat is configured to be removably coupled to said seat support by mechanical length adjustable links and said second seat is removably connected to said seat support by manual length-adjustable links.

13. The apparatus of claim 1, wherein one of said plurality of seats is a sling, and wherein a garment is adapted for placement over said sling when supporting the person in a suspended position.

14. The apparatus of claim 13, wherein said garment has an opening for passage of said seat support.

15. The apparatus of claim 1, wherein portions of said C-shaped frame assembly under excess stress load are reinforced by inserts placed inside a tube and formed together.

16. The apparatus of claim 1, wherein the length of a vertical portion of said positioning bars is sized to provide a removable connection with vertical elements of said top and bottom portions and set said C-shaped frame assembly as a rigid frame configured for removable attachment to said plurality of different seats and components directly or by said removable connecting elements, and wherein the vertical portion of said positioning bars have a combine length to enable positioning said seat attached to the top of said seat support at the heights of the standard commode or wheelchair seat.

17. The apparatus of claim 1, further comprising wheels removably attached to said bottom portion and that are vertically adjustable to provide movements of said C-shaped frame assembly when supporting a person in a horizontal or angular position and wherein a setting wheel position defines an angle and force to move.

* * * * *